US012084876B2

(12) United States Patent
Fejrskov et al.

(10) Patent No.: US 12,084,876 B2
(45) Date of Patent: Sep. 10, 2024

(54) TEMPORARY SCAFFOLDING REST

(71) Applicant: TURNER ACCESS LIMITED, Central Scotland (GB)

(72) Inventors: Mikael Fejrskov, Glasgow (GB); Andrew Wotherspoon, Glasgow (GB)

(73) Assignee: SUNSHINE ENTERPRISE GROUP EU LIMITED, Gateshead (GB)

( * ) Notice: Subject to any disclaimer, the term of this patent is extended or adjusted under 35 U.S.C. 154(b) by 78 days.

(21) Appl. No.: 17/761,923

(22) PCT Filed: Sep. 21, 2020

(86) PCT No.: PCT/GB2020/052277
§ 371 (c)(1),
(2) Date: Mar. 18, 2022

(87) PCT Pub. No.: WO2021/053358
PCT Pub. Date: Mar. 25, 2021

(65) Prior Publication Data

US 2022/0372773 A1 Nov. 24, 2022

(30) Foreign Application Priority Data

Sep. 20, 2019 (GB) ..... 1913618
Jan. 27, 2020 (GB) ..... 2001119

(51) Int. Cl.
*E04G 5/06* (2006.01)
*E04G 5/14* (2006.01)
(Continued)

(52) U.S. Cl.
CPC ..... *E04G 5/061* (2013.01); *E04G 5/147* (2013.01); *E04G 7/308* (2013.01); *E04G 7/34* (2013.01)

(58) Field of Classification Search
CPC ..... E04G 5/061; E04G 5/147; E04G 7/308; E04G 7/34
See application file for complete search history.

(56) References Cited

U.S. PATENT DOCUMENTS

2002/0053486 A1 5/2002 Galdos Urzelai
2021/0032885 A1* 2/2021 Van Oers ..... E04G 7/14

FOREIGN PATENT DOCUMENTS

DE 10243356 A1 2/2004
DE 102019002077 A1 * 10/2020 ..... E04G 1/14
(Continued)

OTHER PUBLICATIONS

International Search Report issued in PCT Patent Application No. PCT/GB2020/052277 dated Apr. 12, 2020.
(Continued)

*Primary Examiner* — Eret C McNichols
(74) *Attorney, Agent, or Firm* — MARSHALL, GERSTEIN & BORUN LLP

(57) ABSTRACT

The invention relates to a temporary scaffolding rest which temporarily supports a standby scaffolding component upon a scaffolding upright in a first temporary disconnected position which is laterally offset from the scaffolding upright for subsequent installation of said standby scaffolding component to a portion of said upright in a second installed position which is laterally inset from the first temporary disconnected position. The temporary scaffolding rest includes a temporary connector for temporarily connecting the temporary scaffolding rest to said portion of said scaffolding upright, and an elongated rest which extends laterally from the temporary connector in order to temporarily support a portion of said standby scaffolding adjacent said portion of said scaffolding upright in said first temporary disconnected laterally offset position ready for subsequent installation to said portion of said scaffolding upright in said
(Continued)

second installed position. A method of erecting a row of scaffolding which is higher than the row of scaffolding upon which an installer is positioned is also provided.

16 Claims, 9 Drawing Sheets

(51) Int. Cl.
*E04G 7/30* (2006.01)
*E04G 7/34* (2006.01)

(56) References Cited

FOREIGN PATENT DOCUMENTS

| | | | | | |
|---|---|---|---|---|---|
| DE | 102019002078 | A1 | * | 10/2020 | ..... E04G 5/007 |
| DE | 102019002287 | A1 | * | 10/2020 | ..... E04G 5/142 |
| EP | 1233122 | A2 | | 8/2002 | |
| EP | 1724414 | A1 | | 11/2006 | |
| EP | 1878850 | A2 | | 1/2008 | |
| EP | 3748107 | A1 | | 12/2020 | |
| FR | 3031539 | A1 | | 7/2016 | |
| GB | 1171126 | A | | 11/1969 | |
| GB | 2500025 | A | | 9/2013 | |
| GB | 2503675 | A | * | 1/2014 | ..... E04G 5/06 |
| GB | 2533033 | A | | 6/2016 | |
| JP | 2005188275 | A | * | 7/2005 | ..... E04G 5/147 |

OTHER PUBLICATIONS

Search Report issued in Great Britain Patent Application No. 2014820.1 dated Mar. 22, 2021.

* cited by examiner

TEMPORARY SCAFFOLDING REST

BACKGROUND

Scaffolding structures typically comprise several different discrete and compact components which are connected to one another during installation at site in order to form a resultant scaffolding framework when erected. Many different connection methods are utilised; however, in the main, these involve erecting a plurality of upstands and then connecting a plurality of cross members therebetween. These cross members may include bracing members, walking boards, kick boards, guardrails etc.

The process of erecting a scaffolding framework typically requires the presence of an installation team of at least two people. A first installer is required to install the upstands and connect the cross members thereto at a lower level. Either that same installer or the second installer then ascends the scaffolding to an upper level and then begins to erect the upper level of scaffolding. The other installer remains on a lower level and is required to lift the next set of upstands/cross members/tools into or near to the hands of the first installer such that the first installer may easily connect the components of the upper level framework together at height. It is generally not feasible for a single installer to construct the scaffolding framework since to do so would require that he climbs down the erected portion of scaffolding to fetch components after connecting each component of the upper level—this would be very time-consuming and may also potentially be dangerous. Attempting to erect the scaffolding utilising only one installer would also involve the installer either attempting to climb back up the portion of partially erected scaffolding with the new component to be attached held in one hand, or would require the installer to somehow attach the new component to the erected scaffolding and hoist it to a higher position. Such a method of installation with one installer is generally either impossible, impractical, time-consuming, and/or contrary to health and safety or other regulations.

Something else which can make known methods of installation difficult to utilise without breaching health and safety or other regulations (regardless of the number of installers utilised) is that certain regulations in certain jurisdictions mandate that the installers are at least partially protected at all times from the risk of fall by way of a physical barrier. This can be difficult or impossible to achieve when an installer is erecting scaffolding overhead. In other words, the scaffolder essentially needs to be able to at least partially erect a row of protected scaffolding above the row on which they, or their fellow installer, are currently positioned.

The speed at which scaffolding can be safely erected and dismantled is also important since labour time is often expensive. Some jobs may also have tight time-based access windows which makes quick and efficient installation and dismantling of the scaffolding important.

In an effort to address some of these problems United Kingdom Patent Publication No. 2533033 shows a lightweight safety paneling and accompanying scaffold system whereby the fitter raises the next section of paneling above his or head and immediately attaches it into its final position, at that raised height, to the scaffolding uprights adjacent the next row of scaffolding. In this arrangement, the upper row of paneling is in its connected configuration immediately after the fitter has installed it from below. The only thing left for the fitter to do is secure it in that same position with a fastener. However, whilst this may partly address at least some of the aforementioned issues, it is limited to relatively lightweight paneling and creates additional issues which make it difficult in practice to use safely and reliably. For example, it requires very accurate placement of the upper portion of scaffold on the upper row from below (not an easy task to achieve when holding a more heavy-duty scaffolding guardrail). This method therefore may also typically require more than one fitter for safety reasons.

SUMMARY OF THE DISCLOSURE

According to the present invention there is provided a temporary scaffolding rest which temporarily supports a standby scaffolding component upon a scaffolding upright in a first temporary disconnected position which is laterally offset from the scaffolding upright for subsequent installation of said standby scaffolding component to a portion of said upright in a second installed position which is laterally inset from the first temporary disconnected position, the temporary scaffolding rest comprising:

at least a temporary connector for temporarily connecting the temporary scaffolding rest to said portion of said scaffolding upright; and at least an elongated rest which extends laterally from the temporary connector in order to temporarily support a portion of said standby scaffolding adjacent said portion of said scaffolding upright in said first temporary disconnected laterally offset position ready for subsequent installation to said portion of said scaffolding upright in said second installed position.

Optionally, the temporary scaffolding rest further comprises at least a stand-off arm which extends inwardly from the connector past the scaffolding upright and at least partially projects into a working zone of the scaffolding in order allow said scaffolding component to be temporarily rested upon the scaffolding rest within the working zone.

Optionally, the connector is arranged to engage with an outward portion of said scaffolding upright which is outside of the working zone.

Optionally, the or each stand-off arm comprises a first substantially level portion and a second inclined portion.

Optionally, the second inclined portion of the or each stand-off arm comprises a rest profile for temporarily receiving a portion of a scaffolding component therein in a temporary resting configuration.

Optionally, the or each rest profile comprises a U-shaped recess.

Optionally, the or each stand-off arm comprises a return hook portion for retaining the scaffolding component upon the or each stand-off arm.

Optionally, the first substantially level portion of the stand-off arm is angled relative to the connecter so as to project into the working zone at an angle which allows the stand-off arm to pass around the inward scaffolding upright and into the working zone.

Optionally, the temporary scaffolding rest further comprises a pair of said stand-off arms, the pair of said stand-off arms being angled relative to one another so as to pass around the inward scaffolding upright.

Optionally, the pair of second inclined portions of the stand-off arm are angled relative to the first substantially level portions so as to align with one another.

Optionally, the pair of second inclined portions of the stand-off arms are inclined so as to position a lower surface of each rest profile at a height which is higher than the point at which the temporary scaffolding apparatus connects to the portion of scaffolding upright by the connector.

Optionally, the connector is adapted to connect with a connection cup of a scaffolding upright.

Optionally, the connector comprises a hooked nose which engages with the connection cup of the scaffolding upright.

Optionally, the temporary scaffolding rest further comprises an upright spacer bar which projects downwardly from the connector to allow a lower portion of the scaffolding rest to be connected to an upright tubular of the scaffolding arrangement at a point which is lower than the point at which the connector attaches to the scaffolding.

Optionally, the temporary scaffolding rest further comprises a securing clip positioned at or toward a lower end of the upright spacer bar and which provides an additional point of attachment between the temporary scaffolding rest and the scaffolding upright.

Optionally, the temporary scaffolding rest further comprises at least a pair of temporary scaffolding rests according to the invention, wherein the temporary scaffolding rests are positioned longitudinally apart from one another along a front portion of a scaffolding working zone so as to allow a either end of a scaffolding component to be temporarily rested upon a temporary scaffolding rest provided at either end thereof.

According to a further aspect of the present invention there is provide a method of erecting a row of scaffolding which is higher than the row of scaffolding upon which an installer is positioned, the method comprising the steps of: — connecting a first temporary scaffolding rest according to the invention to a first upper scaffolding upright;

connecting a second temporary scaffolding rest according to the invention a second upper scaffolding upright;

attaching the pair of upper scaffolding uprights to a pair of lower scaffolding uprights longitudinally spaced apart from one another;

raising a scaffolding component above the height of the installer and resting said scaffolding component upon the rests of the temporary scaffolding rest in a disconnected configuration at either end of the row of scaffolding for subsequent connection of said scaffolding component to said first and second upper scaffolding uprights;

the installer ascending to the upper row of scaffolding; and the installer connecting both ends of the rested scaffolding component to the adjacent upper scaffolding uprights.

BRIEF DESCRIPTION OF THE FIGURES

Further features and advantages of the present invention will become apparent from the following description, and the attached diagrams, in which: —

DETAILED DESCRIPTION

Figure 1C:
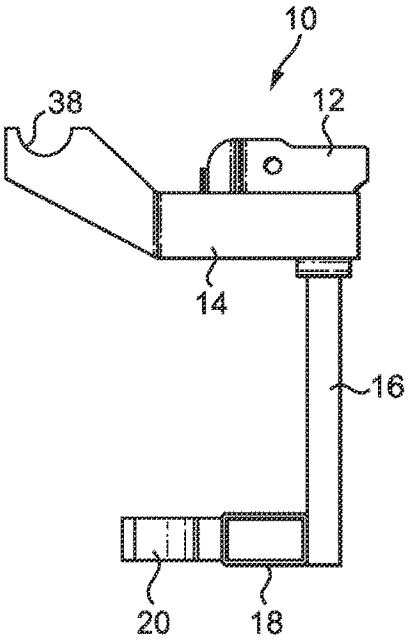
FIG. 1C is a transverse illustration of the temporary scaffolding rest of FIG. 1A.
Figure 1B:
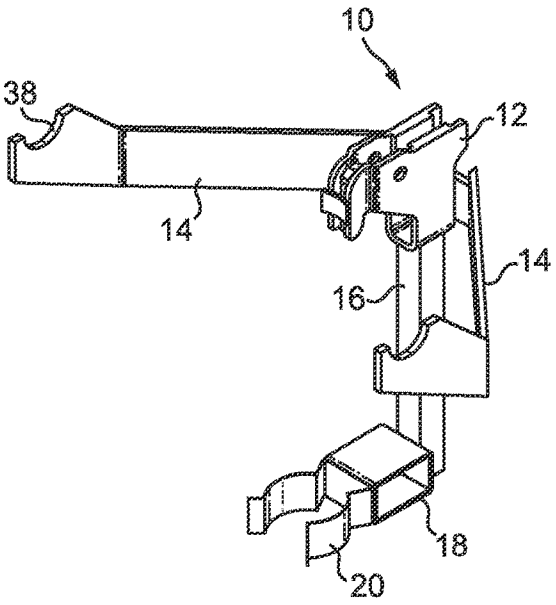
FIG. 1B is a front perspective illustration of the temporary scaffolding rest of FIG. 1A.
Figure 1A:
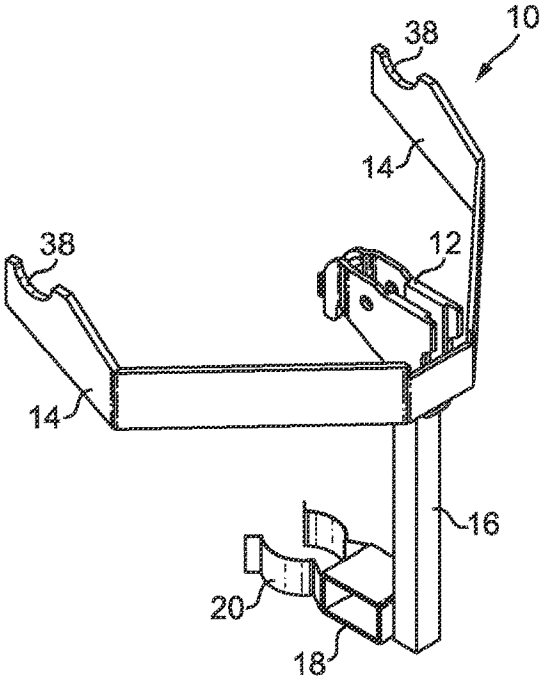
FIG. 1A is a rear perspective illustration of a temporary scaffolding rest of the present invention.

When components of scaffolding are connected to one another they typically create a "wall" of scaffolding which (typically in conjunction with other structures and/or other walls of scaffolding) defines a protected working area, or work zone (such as a walking platform or other area) on an inner side of the scaffolding wall. The scaffolding wall therefore has an inner, or front, side (toward or adjacent the working area) and a rear, or outer, side (toward the opposite unprotected side of the scaffolding—normally at a raised height above the ground).

A temporary scaffolding rest generally designated 10, comprises a hook shaped connector 12 attached at its rear to a pair of stand-off arms 14 and an upright spacer bar 16 which projects downwardly therefrom. The upright spacer bar 16 is provided with a lower stand-off block 18 projecting inwardly therefrom and which in turn is provided with a securing clip 20 projecting inwardly therefrom.

Figure 5A:
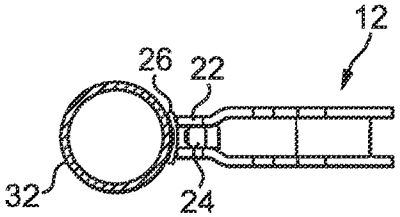
FIG. 5A is a plan-view cross section of a connector of the temporary scaffolding rest abutted against a tubular of a scaffolding upright whilst connected to a connecting cup of the scaffolding upright. For clarity, the stand-off arms are not illustrated in this drawing.
Figure 5B:
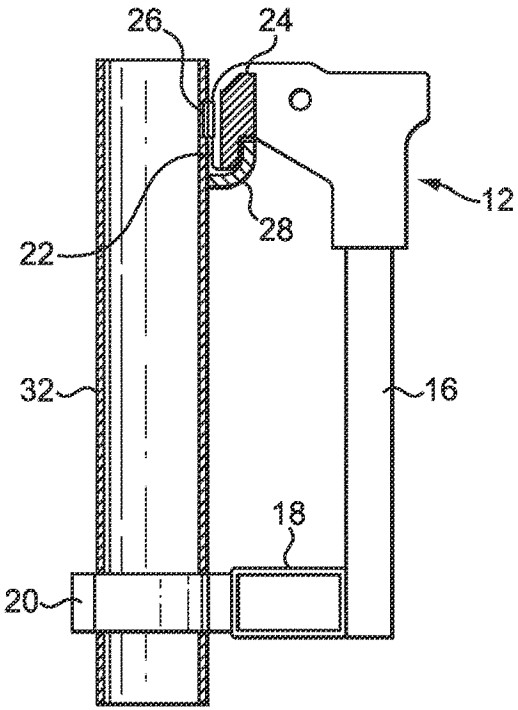
FIG. 5B is a transverse partial cross section of the temporary scaffolding rest of FIG. 5A also illustrating engagement between the lower securing clip and the tubular of the scaffolding upright. For clarity, the stand-off arms are not illustrated in this drawing.

As best illustrated in FIGS. 5A and 5B, the hook shaped connector 12 comprises a pair of side plates each having a hook shaped nose section 22, an attachment key 24 positioned therebetween and a bridge support 26 which connects each end of the hook shaped nose section 22 to one another. The connector 12 allows secure engagement with the lip of a connecting cup 28 of a scaffolding upright 30 in a known attachment fashion.

Figure 5C:
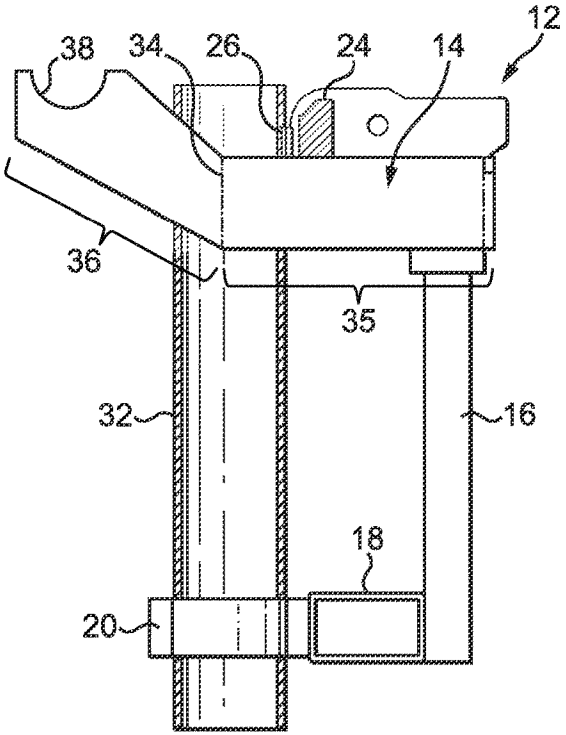
FIG. 5C is a further view of the FIG. 5B arrangement with the stand-off arms illustrated.
Figure 5D:
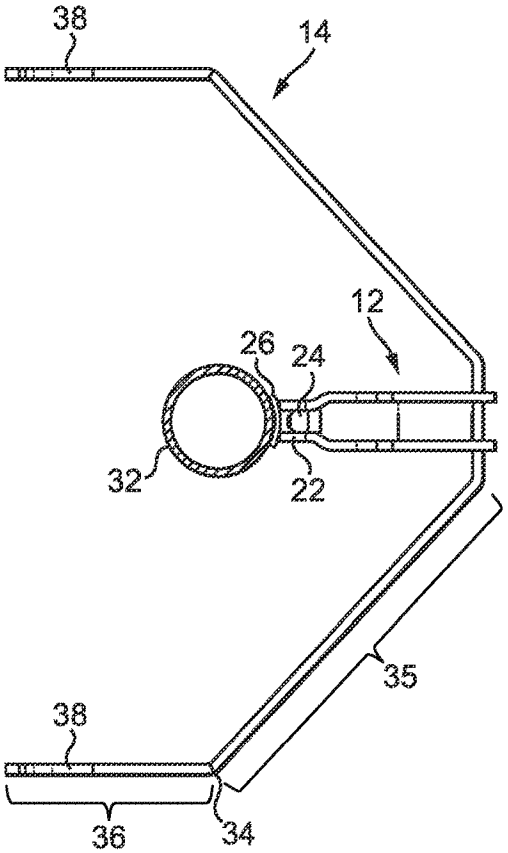
FIG. 5D is a further view of the FIG. 5A arrangement with the stand-off arms illustrated.
Figure 6A:
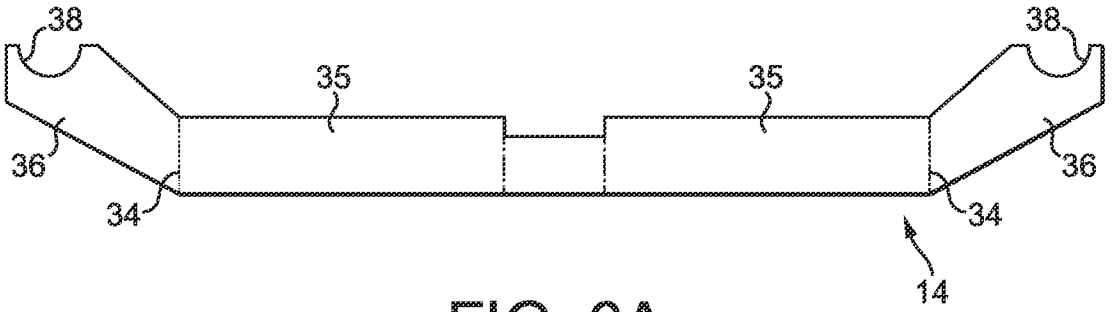
FIG. 6A is a rear-view illustration of the stand-off arms in isolation.
Figure 6B:
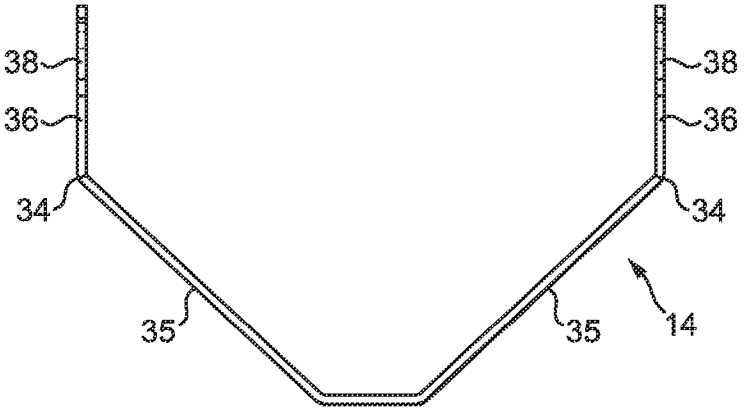
FIG. 6B is plan-view illustration of the stand-off arms in isolation.

As best illustrated in FIGS. 5C and 5D, each of the stand-off arms 14 project outwardly from the rear of the connector 12 at approximately 90 degrees to one another at a first level portion 35 in order to pass around and clear of a tubular 32 of a scaffolding upright 30. The arms 14 then change direction at 34 such that they project inwardly and parallel to one another at a second inclined portion 36. As best illustrated in FIG. 5C, the inclined portions 36 are inclined relative to the level portions 35 in order to raise the ends thereof above that of the level portions 35. The stand-off arms 14 are each provided with a U-shaped recess 38 toward their distal ends which form a rest for temporarily receiving a component of scaffolding therein, as will be described subsequently.

The upright spacer bar 16 projects downwardly from the rear of the hook shaped connector 12 and is formed of a square cross section bar. The lower stand-off block 18 is attached to the lower end of the upright spacer bar 16. The block 18 comprises a rectangular cross section and projects perpendicularly inwards from the upright spacer bar.

The securing clip 20 has a pair of prongs projecting from its base, the width, radius and mechanical resilience of which are selected during manufacture to ensure that the clip 20 may securely engage with a standard tubular of a scaffolding upright and be retained securely thereupon.

Figure 8:
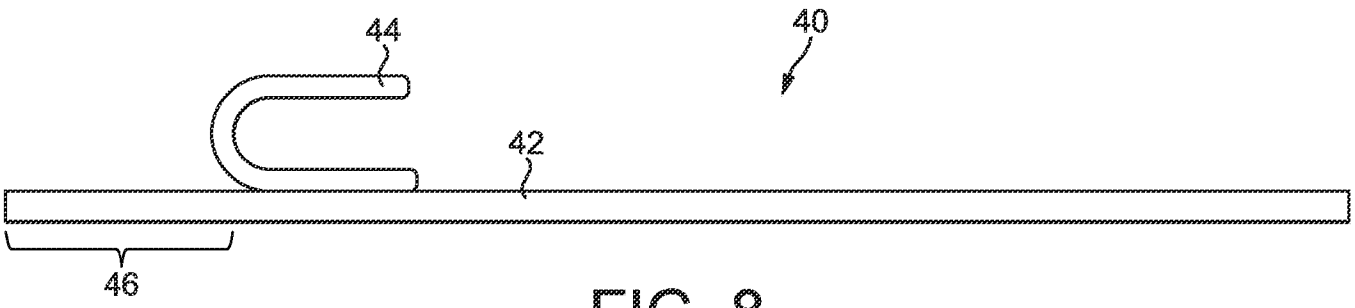
FIG. 8 is an illustration of an installation arm for use with the temporary scaffolding rest of the invention.

With reference to FIG. 8 an installation arm 40 comprises an elongated handle 42 which is provided with a storage hook 44 and an engagement prong 46. The purpose of the installation arm 40 will be described subsequently. The storage hook 44 may be used to temporarily hook the arm onto components of scaffolding at the lower level to facilitate efficient installation.

In use, an installer will typically first erect a lower row of scaffolding as a first step. This lower row of scaffolding will typically comprise a series of lower scaffolding uprights at the corners of each section thereof, and at standard positions there-along.

Figure 2C:
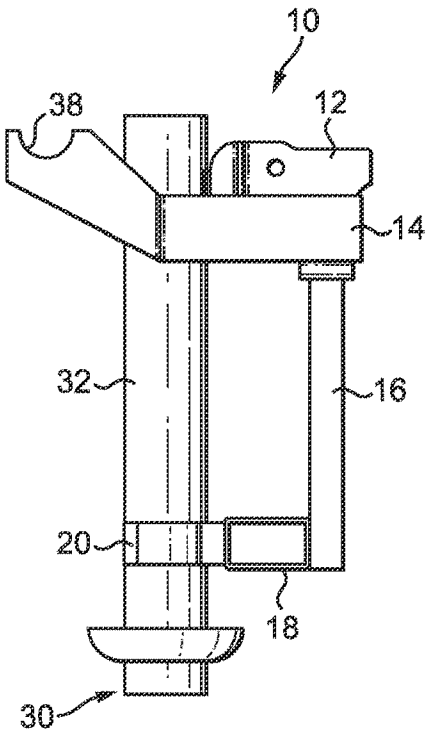
FIG. 2C is a transverse illustration of the temporary scaffolding rest of FIG. 2A.
Figure 2B:
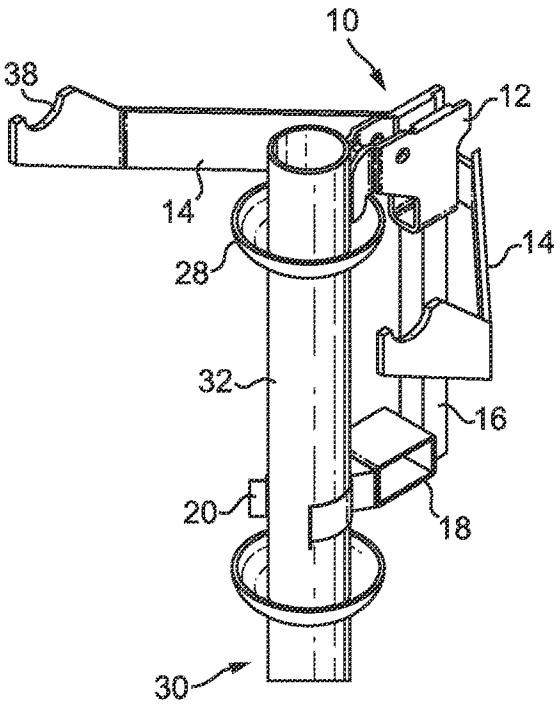
FIG. 2B is a front perspective illustration of the temporary scaffolding rest of FIG. 2A.
Figure 2A:
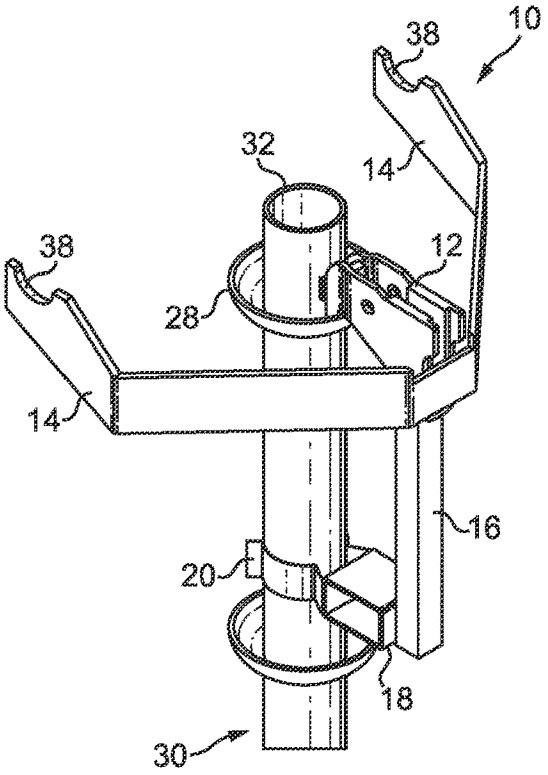
FIG. 2A is a rear perspective illustration of a temporary scaffolding rest of the present invention where the scaffolding rest is attached to a connecting cup of a scaffolding upright at its upper end and to a scaffolding upright tubular at its lower end.

When it is desired to erect the next row of scaffolding (which will necessarily be at a higher level than the first) the temporary scaffolding rest 10 is first secured onto an additional detached scaffolding upright 30. With reference to FIGS. 2A to 2C, this is achieved by engaging the hook shaped connector 12 into the lip of the connecting cup 28 of the detached upright whilst simultaneously securing the lower end of the rest 10 by pushing the attachment clip 20 around the tubular 32 of the upright 30. The engagement between the connector 12 and cup 28 at the upper end of the apparatus, combined with the securing clip and tubular at the lower end of the apparatus, co-act with one another to secure the rest 10 upon the detached upright 30. The upright 30 may have several connecting cups 28 provided along its length in order to allow for connection of components thereto at a variety of different heights.

The scaffolding upright 30 (with attached rest 10) is then attached to one of the lower scaffolding uprights in the normal way in an appropriate position in order to form a vertically extended resultant upright having a rest 10 positioned at height thereon. This process is repeated for several uprights in order that several of the rests 10 are positioned at height upon their respective extended resultant uprights (thereby awaiting subsequent placement of the upper row of scaffolding therebetween). The arms 14 of each rest 10 all project inwardly into the protected work zone of the scaffolding framework. Cross-bracing components may now be attached between the extended resultant uprights if desired in order to structurally strengthen the resultant framework.

At the same time as locating the rests 10 at height by pre-preparing the upper uprights 30 and then attaching those uprights to the lower uprights, the installer may also choose to pre-attach other small components (such as short end-piece guardrails) to the uprights prior to raising them onto the lower uprights if desired.

While remaining positioned at the lower row of scaffolding, the installer then retrieves a full-length guardrail (or whichever other desired scaffolding component is to be attached at the upper row of scaffolding) and holds one end thereof. This enables him to raise the other end above his head height and easily place a rail of that guardrail at that other end into the U-shaped recess 38 of a rest 10 at one end of the scaffolding framework. No elongating tool is required for this step since the full length of the rail can instead be used by the installer "walking" his or hands down the rail during installation. The installer can then rest the lower end of the guardrail on the lower row and let go of the guardrail. The guardrail will be retained in that position (raised at one end and laterally offset from the upright 30) by the engagement between the rail and recess 38 of the rest 10. It will be appreciated by the reader that the recess 38 allows the rail to be rested there within at any point along the length of the rail and hence positioning of the rail does not need to be particularly accurate.

The installer then retrieves the installation arm 40, raises the other lower end of the guardrail to his chest height and then inserts the engagement prong 46 into the lower end of a tubular (commonly provided) of the other, lower, guardrail end. The outer side of the hook 44 will abut against the tubular of the guardrail to prevent the arm 40 sliding all the way into the interior of the tubular. The installer then grips the elongated handle 42 which allows him to lift that end of the guardrail into an elevated position above his head height such that he may easily then place the other end of the rail into the U-shaped recess at the next rest 10 of the previously installed elongated uprights. Again, it will be appreciated by the reader that the recess 38 allows the rail to be rested there within at any point along the length of the rail and hence positioning of the rail does not need to be particularly accurate.

Figure 3C:
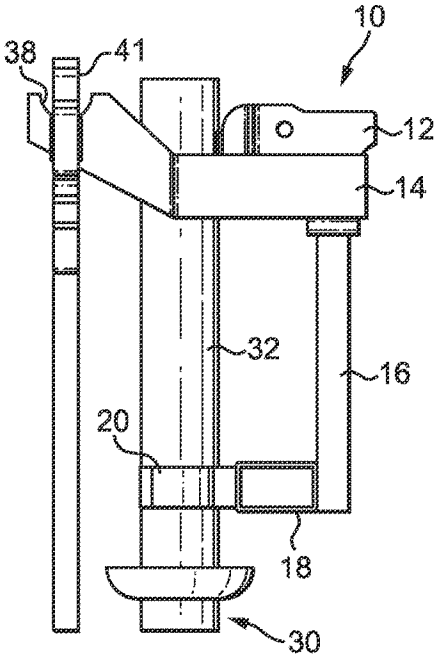
FIG. 3C is a transverse illustration of the temporary scaffolding rest of FIG. 3A.
Figure 3B:
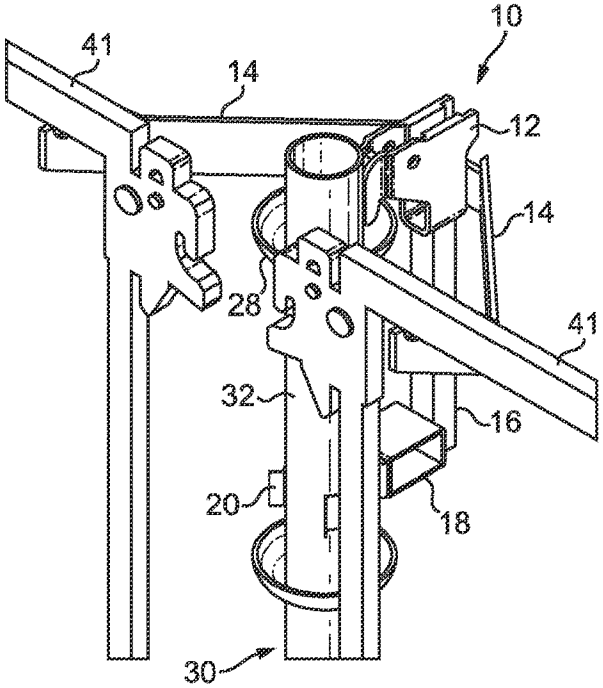
FIG. 3B is a front perspective illustration of the temporary scaffolding rest of FIG. 3A.
Figure 3A:
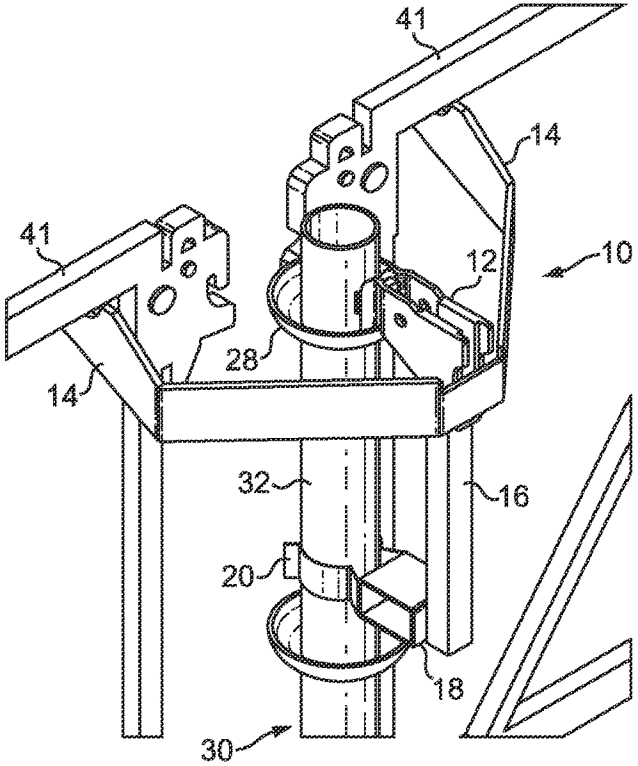
FIG. 3A is a rear perspective illustration of a temporary scaffolding rest of the present invention while temporarily supporting a scaffolding guardrail component on either side of the scaffolding upright ready for subsequent attachment of the guardrails to the connecting cup of the scaffolding upright.
Figure 4C:
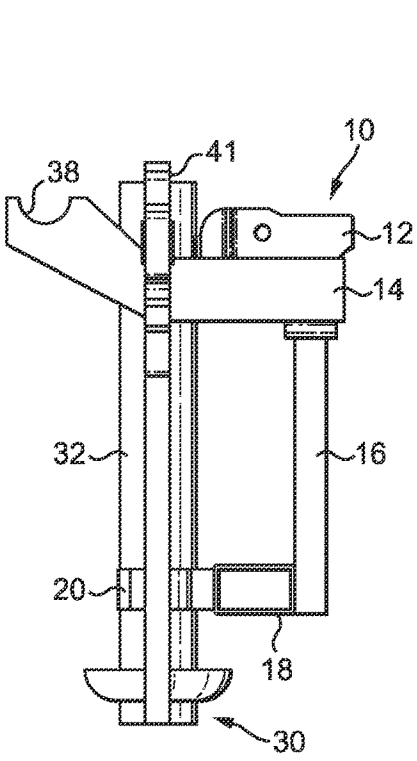
FIG. 4C is a transverse illustration of the temporary scaffolding rest of FIG. 4A.
Figure 4B:
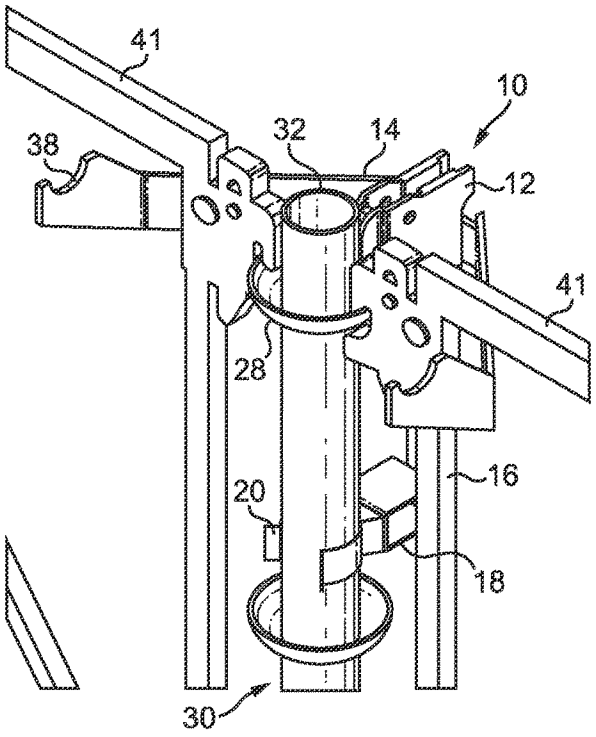
FIG. 4B is a front perspective illustration of the temporary scaffolding rest of FIG. 4A.
Figure 4A:
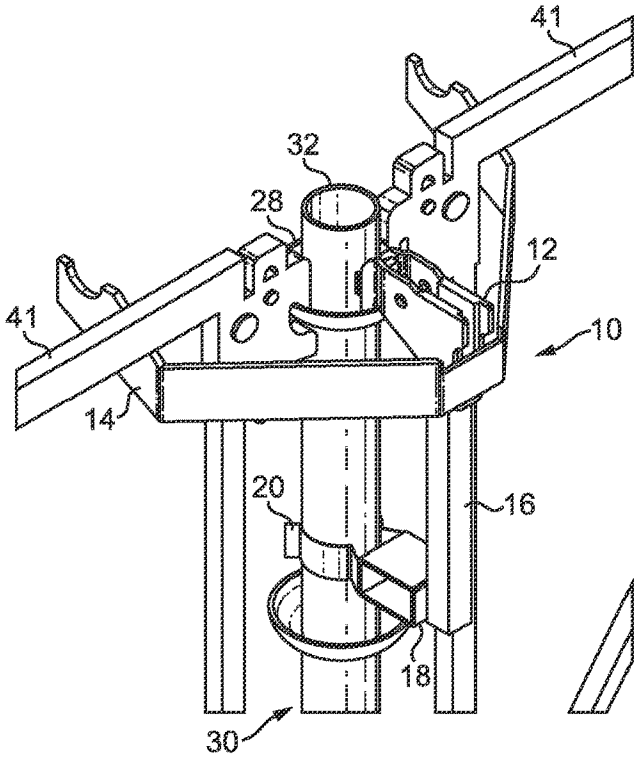
FIG. 4A is a rear perspective illustration of a temporary scaffolding rest of the present invention where each of the guardrail components have been removed from their temporary location and attached to the connecting cup of the upright.

This results in the guardrail 41 being temporarily suspended between a pair of uprights by the U-shaped recesses 38 at either end thereof in the elevated and disconnected position—as shown in FIGS. 3A to 3C. The raised guardrail is therefore temporarily supported as a section of standby scaffolding in the offset position which is dictated by the position of the U-shaped recesses 38 on the stand-off arms 14. This step is repeated until several standby guardrails are suspended in the elevated and offset (relative to the upstands 30) position at the next intended row of scaffolding by several of the rests 10. Hence the process provides a partially pre-prepared row of standby disconnected scaffolding at the next row above that where the installers are positioned.

The installer then installs walk boards or other standing support on the partially pre-prepared upper level of scaffolding and climbs on to that upper level of scaffolding by way of a ladder or other structure. At this point, the installer is partly protected from falling by the previously positioned, temporarily suspended standby and disconnected guardrails. Now positioned on the upper row of scaffolding, the installer then simply lifts the end corners of each disconnected guardrail from their standby laterally offset and disconnected position and moves them laterally onto the attachment cups of the adjacent uprights and attaches them thereto in the normal way in an installed position until that row of guardrails is securely installed and erection of that row of scaffolding is complete.

The installer then unclips each of the apparatus from the uprights and begins the process again for the next upper row of scaffolding.

In this way, only one installer is required in order to erect the scaffolding framework since that installer can position the next, upper row of guardrails from his position on the row below and, when he ascends to the next row, will be partially protected from fall by the partially pre-prepared, disconnected guardrails. Whilst the guardrails are not fully installed and hence do not immediately provide full protection this is nonetheless an improvement on prior art systems. Furthermore, the duration of time and the number of installation manoeuvres the installer must undertake, while not fully protected is greatly minimised since when the installer ascends to the next pre-prepared row of scaffolding he then simply needs to lift the ends of the guardrails a very small distance into secured engagement with the connecting cups 28 of the uprights.

Dismantling of the scaffolding framework is similarly facilitated by the presently described apparatus in a similar fashion to that previously described yet with substantially the opposite steps being carried out as will be appreciated by the reader.

The user may nonetheless elect to still utilise more than one installer if required or desired; however, the features and advantages of the apparatus mean that this may no longer be mandatory.

Figure 7A:
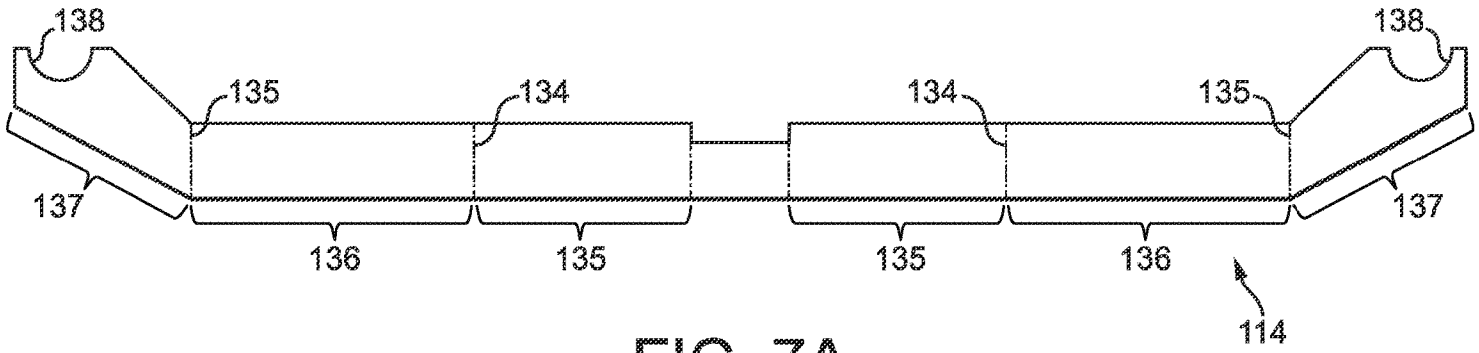
FIG. 7A is a rear-view illustration of alternatively shaped stand-off arms in isolation.
Figure 7B:
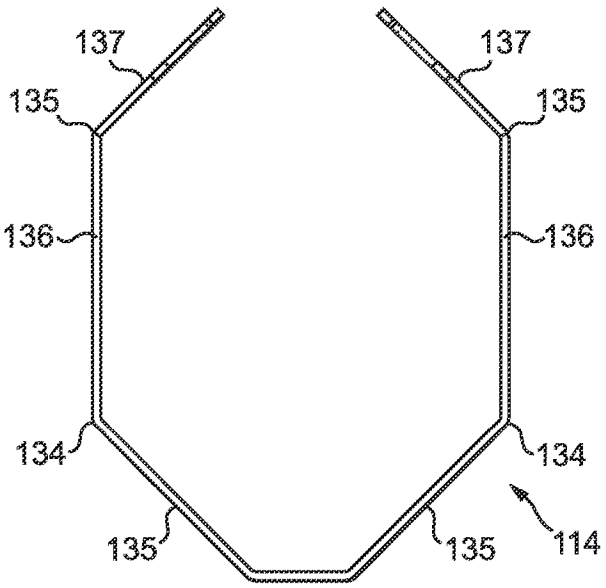
FIG. 7B is a plan-view illustration of the alternatively shaped stand-off arms in isolation.

With reference to FIGS. 7A and 7B, an alternative embodiment of the invention is described subsequently. In order to minimise repetition, similar features of this embodiment are numbered with a common two-digit reference numeral and are differentiated by a third digit placed before the two common digits. Such features are structured similarly, operate similarly, and/or have similar functions unless otherwise indicated.

In an alternatively profiled embodiment, each of the stand-off arms 114 project outwardly from the rear of the connector at approximately 90 degrees to one another at a first level portion 135. The arms 114 then change direction at 134 such that they project inwardly and parallel to one another at a second level portion 136. The arms 114 then change direction again at 135 such that they are angled inwardly towards one another at a third inclined portion 137. This arrangement facilitates passage of the arms 114 around and clear of a tubular of a scaffolding upright. As with the previously described embodiment, the arms 114 are each provided with a U-shaped recess 138 which forms a rest for temporarily receiving a component of scaffolding therein.

Figure 9A:
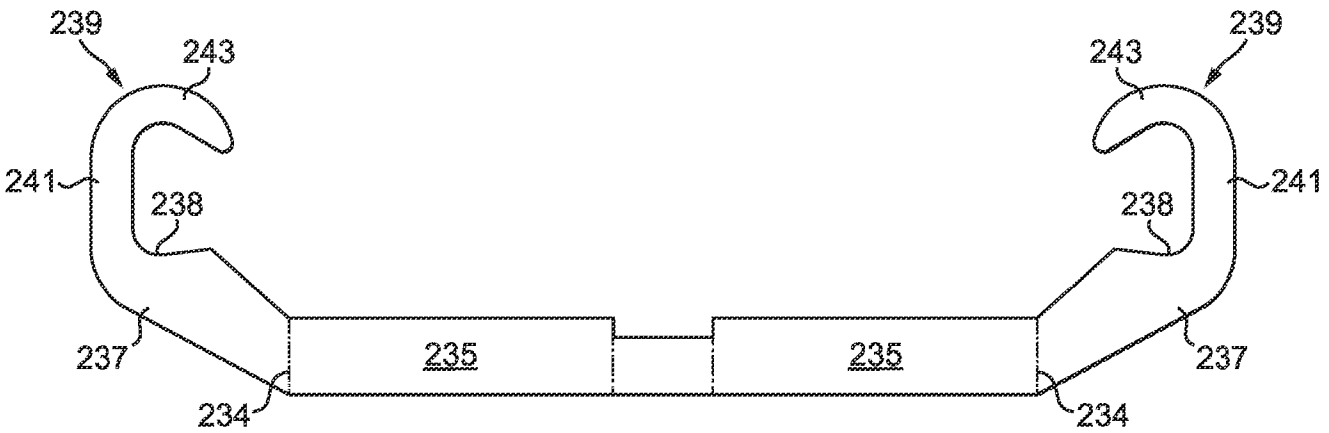
FIG. 9A is a rear-view illustration of the stand-off arms in isolation according to a second embodiment of the invention where return hooks are provided toward the distal ends of the stand-off arms.
Figure 9B:
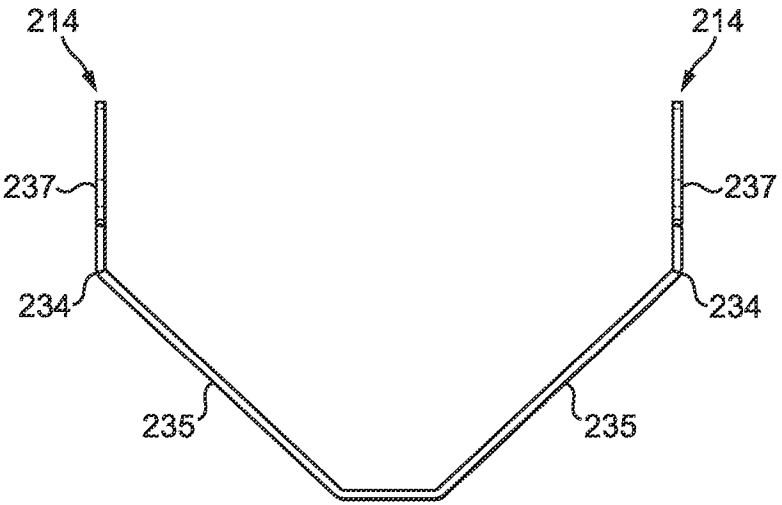
FIG. 9B is plan-view illustration of the stand-off arms of FIG. 9A.

With reference to FIGS. 9A and 9B, a yet further alternative embodiment of the invention is described subsequently.

In an alternatively profiled embodiment, each of the stand-off arms 214 project outwardly from the rear of the connector at approximately 90 degrees to one another at a first level portion 235. The arms 214 then change direction at 234 and project parallel with one another at an end portion 237.

With particular reference to FIG. 9A, the end portions 237 are each provided with return hooks 239 each having a cradled recess 238, vertical column 241 and an upper hooked portion 243. As with previous embodiments, each cradled recess 238 forms a rest for temporarily receiving a cross bar or other portion of a component of scaffolding therein; however, the vertical column 241 and hooked portions 243 act to minimise the possibility of the guard rail cradled thereby from accidentally being knocked out or otherwise removed from engagement therewith.

In use, this further embodiment of the invention works in substantially the same way as previously described embodiments whilst simply requiring the installer to navigate the cross bar of the guardrail or other scaffolding component past the hooked portion 243 and into the cradled recess 238 during placement of the upper portion of guardrail into the temporary offset and disconnected position.

Although particular embodiments of the invention have been disclosed herein in detail, this has been done by way of example and for the purposes of illustration only. The aforementioned embodiments are not intended to be limiting with respect to the scope of the statements of invention.

It is contemplated by the inventors that various substitutions, alterations, and modifications may be made to the invention without departing from the scope of the invention as defined by the claims. For example:

Although the apparatus is described in use during installation of several guardrails, the reader will appreciate that it may be utilised to temporarily support, and then install and erect, several other scaffolding components as desired.

The invention claimed is:

1. A temporary scaffolding rest which temporarily supports a standby scaffolding component upon a scaffolding upright in a first temporary disconnected position which is laterally offset from the scaffolding upright for subsequent installation of said standby scaffolding component to a portion of said upright in a second installed position which is laterally inset from the first temporary disconnected position, the temporary scaffolding rest comprising:

at least a temporary connector for temporarily connecting the temporary scaffolding rest to said portion of said scaffolding upright; and at least an elongated rest which extends laterally from the temporary connector in order to temporarily support a portion of said standby scaffolding adjacent said portion of said scaffolding upright in said first temporary disconnected laterally offset position ready for subsequent installation to said portion of said scaffolding upright in said second installed position, the elongated rest comprising:

at least a stand-off arm which extends inwardly from the connector past the scaffolding upright and at least partially projects into a working zone of the scaffolding in order allow said scaffolding component to be temporarily rested upon the scaffolding rest within the working zone, wherein the connector is arranged to engage with an outward portion of said scaffolding upright which is outside of the working zone.

2. A temporary scaffolding rest according to claim 1, wherein the or each stand-off arm comprises a first substantially level portion and a second inclined portion.

3. A temporary scaffolding rest according to claim 2, wherein the second inclined portion of the or each stand-off arm comprises a rest profile for temporarily receiving a portion of a scaffolding component therein in a temporary resting configuration.

4. A temporary scaffolding rest according to claim 3, wherein the or each rest profile comprises a U-shaped recess.

5. A temporary scaffolding rest according to claim 4, wherein the or each rest profile further comprises a return hook portion for facilitating retention of the scaffolding component upon the or each stand-off arm.

6. A temporary scaffolding rest according to claim 2, wherein the first substantially level portion of the stand-off arm is angled relative to the connecter so as to project into the working zone at an angle which allows the stand-off arm to pass around the inward scaffolding upright and into the working zone.

7. A temporary scaffolding rest according to claim 6, comprising a pair of said stand-off arms, the pair of said stand-off arms being angled relative to one another so as to pass around the inward scaffolding upright.

8. A temporary scaffolding rest according to claim 7, wherein the pair of second inclined portions of the stand-off arm are angled relative to the first substantially level portions so as to align with one another.

9. A temporary scaffolding rest according to claim 8, wherein the pair of second inclined portions of the stand-off arms are inclined so as to position a lower surface of each rest profile at a height which is higher than the point at which the temporary scaffolding apparatus connects to the portion of scaffolding upright by the connector.

10. A temporary scaffolding rest according to claim 1, wherein the connector is adapted to connect with a connection cup of a scaffolding upright.

11. A temporary scaffolding rest according to claim 10, wherein the connector comprises a hooked nose which engages with the connection cup of the scaffolding upright.

12. A temporary scaffolding rest according to claim 1, further comprising an upright spacer bar which projects downwardly from the connector to allow a lower portion of the scaffolding rest to be connected to an upright tubular of the scaffolding arrangement at a point which is lower than the point at which the connector attaches to the scaffolding.

13. A temporary scaffolding rest according to claim 12, further comprising a securing clip positioned at or toward a lower end of the upright spacer bar and which provides an additional point of attachment between the temporary scaffolding rest and the scaffolding upright.

14. A temporary scaffolding rest system comprising at least a pair of temporary scaffolding rests according to claim 1, wherein the temporary scaffolding rests are positioned longitudinally apart from one another along a front portion of a scaffolding working zone so as to allow a either end of a scaffolding component to be temporarily rested upon a temporary scaffolding rest provided at either end thereof.

15. An installation arm having an elongated portion and a connection portion configured to allow mechanical communication with a portion of the temporary scaffolding rest according to claim 1 such that the installation arm may be utilised to allow a portion of scaffolding to be raised by hand, by an operator positioned at a lower level than a row of scaffolding to be installed, and into temporary resting engagement with the scaffolding.

16. A method of erecting a row of scaffolding which is higher than the row of scaffolding upon which an installer is positioned, the method comprising the steps of:

connecting a first temporary scaffolding rest according to claim 1 to a first upper scaffolding upright;

connecting a second temporary scaffolding rest according to claim 1 to a second upper scaffolding upright;

attaching the pair of upper scaffolding uprights to a pair of lower scaffolding uprights longitudinally spaced apart from one another;

raising a scaffolding component above the height of the installer and resting said scaffolding component upon the rests of the temporary scaffolding rest in a disconnected configuration at either end of the row of scaffolding for subsequent connection of said scaffolding component to said first and second upper scaffolding uprights;

the installer ascending to the upper row of scaffolding; and the installer connecting both ends of the rested scaffolding component to the adjacent upper scaffolding uprights.

* * * * *